United States Patent [19]

Cunningham et al.

[11] 4,180,171

[45] Dec. 25, 1979

[54] CRANES

[75] Inventors: Sinclair U. Cunningham; Donald Firth; Douglas Jackson, all of East Kilbride, Scotland

[73] Assignee: Secretary of State for Industry in Her Britannic Majesty's Government of the United Kingdom of Great Britain and Northern Ireland, London, England

[21] Appl. No.: 828,595

[22] Filed: Aug. 29, 1977

[30] Foreign Application Priority Data

Sep. 1, 1976 [GB] United Kingdom ..... 36244/76

[51] Int. Cl.[2] ..... B66D 1/50

[52] U.S. Cl. ..... 212/61; 254/172; 254/173 R

[58] Field of Search ..... 212/3, 61; 214/13, 14; 254/172, 173 R

[56] References Cited

U.S. PATENT DOCUMENTS

| | | | |
|---|---|---|---|
| 3,189,195 | 6/1965 | Fox, Jr. et al. | 254/173 R |
| 3,189,196 | 6/1965 | Carl et al. | 254/173 R |
| 3,662,991 | 5/1972 | Lakiza et al. | 214/14 |

*Primary Examiner*—Lawrence J. Oresky

*Attorney, Agent, or Firm*—Cushman, Darby & Cushman

[57] ABSTRACT

A crane with a crane rope; means for attaching a load to the crane rope; a crane winch having a drum on which the crane rope can be wound; a crane motor which can drive the crane winch for hauling in or letting out the crane rope; a measuring winch having a drum with a measuring line windable thereon of length sufficient to reach at least as far as the crane rope can reach; a measuring winch motor which can turn the measuring winch drum to wind in or out the measuring line; means for attaching the outer extremity of the measuring line, away from the drum, to the load to be lifted by the crane; first transducer means operated by the measuring winch to provide a displacement signal proportional to any change, in relation to a predetermined value, and having regard to sign, of the length of measuring line extending from the measuring winch drum to the load; and crane motor control means operable by the displacement signal to control the crane motor to haul in or let out the crane rope substantially in synchronism with any motion of the outer extremity of the measuring line.

5 Claims, 2 Drawing Figures

CRANES

Figure 1:
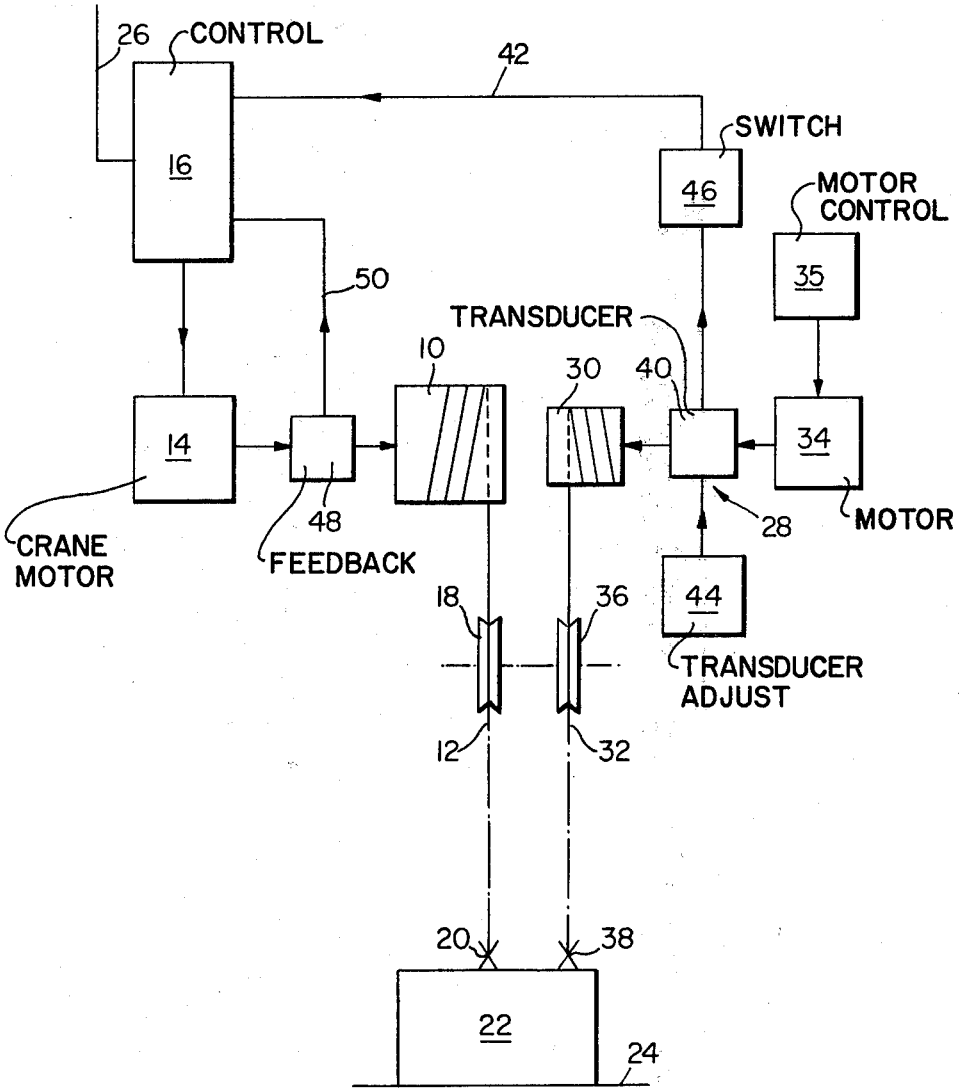

This invention relates to cranes for lifting and lowering of loads.

It is common in the course of unloading ships to have to lift goods from a ship which has a more or less irregular up and down motion, imparted to the ship by the water in which it floats. Heaving of the ship makes it very difficult, and in many situations impossible, for a crane driver to raise a load from the ship without snatch being produced in the crane rope (by snatch being understood a suddenly applied, and usually high, tensile force analogous to impact). If severe enough, snatch will break the crane rope, and in any case applies severe forces to the crane structure.

The problem of snatch in crane ropes is perhaps most severe in relation to the unloading of supplies from a ship onto an off-shore oil-rig, and it is with this situation that the present invention is most closely concerned. The present invention provides means which can at least substantially reduce snatch in a crane rope in the lifting of a load from a heaving ship.

An additional difficulty, again usually most severe in connection with the supplying of off-shore oil-rigs, is horizontal movement of the supply ship. Such horizontal motion can give rise to snatch in the crane rope, and further can cause a load to come violently into contact with part of the supply ship, due to the load's becoming unsupported if the crane rope is initially taut. The present invention provides means which can substantially alleviate hazards resulting from horizontal movement of a ship in relation to a crane which is unloading it.

According to the invention a crane has a crane rope; means for attaching a load to said crane rope; a crane winch having a drum on which said crane rope can be wound; a crane motor which can drive said crane winch for hauling in or letting out said crane rope; a measuring winch having a drum with a measuring line windable thereon of length sufficient to reach at least as far as the crane rope can reach; a measuring winch motor which can turn the measuring winch drum to wind in or out said measuring line; means for attaching the outer extremity of the measuring line, away from the drum, to one of a load to be lifted by said crane and a deck supporting said load; first transducer means operated by the measuring winch to provide a displacement signal proportional to any change, in relation to a predetermined value, and having regard to sign, of the length of measuring line extending from the measuring winch drum to the said load; and crane motor control means operable by said displacement signal to control the crane motor to haul in or let out the crane rope substantially in synchronism and to the same extent with any motion of the outer extremity of the measuring line.

Desirably the crane is provided with slewing means, to slew the crane about a vertical axis, incuding a slewing motor and slewing motor control means; and a second transducer which produces an angle signal related in magnitude and sign to angular displacement of the crane rope, from a given angle, including zero, from the vertical, normal to its radial distance from the said vertical axis; and arranged so that any said angle signal is fed to said slewing motor control means to actuate the slewing motor and slew the crane so that any said angular displacement will be substantially counteracted.

The second transducer may be arranged also to produce a second angle signal related in magnitude and sign to angular displacement of the crane rope, from a given angle, including zero, from the vertical, in a direction radial to the said vertical axis; and arranged so that said second angle signal controls, in the crane, luffing gear so that said angular displacement, to which said second angle signal is related, will be substantially counteracted.

Preferably means are provided for producing a velocity signal related to rotation of the crane winch drum, with which negative feedback can be applied through the crane motor control means to the crane motor. Similar means may be provided for applying negative feed-back to control of the slewing motor.

Preferably the crane is provided with manual control means, and switch means whereby the transducer can be disconnected from the motor control means so that the motor is controllable through said manual control means.

Figure 2:
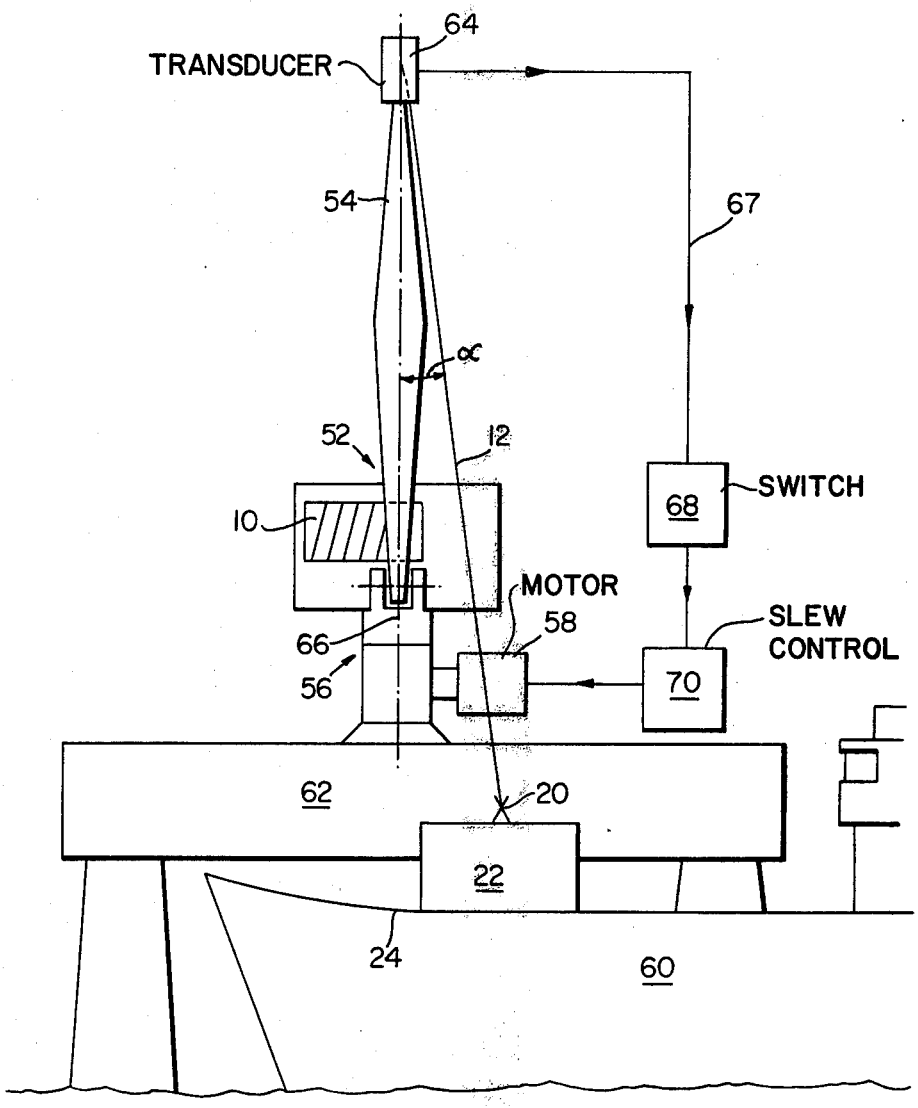

The invention will be described, by way of example only, with reference to the accompanying drawings, in which FIG. 1 illustrates highly diagrammatically a crane winch, controls therefor and means for heave compensation; that is means compensating for vertical motion of a ship from which a load has to be raised FIG. 2 illustrates, also diagrammatically, means compensating for horizontal motion of such ship.

For simplicity, in FIG. 1, the crane jib and its mounting have been omitted. The crane is provided with a winch, which has a drum 10 to which the crane rope 12 is secured; a crane motor 14 drives the drum 10 to haul rope in or let it out from same. The motor 14 is controlled by crane motor control means indicated generally by 16. The crane rope 12 passes from the drum, over a pully 18 at the head of the crane jib (not shown) and is provided at its extremity with attaching means 20 (such as a conventional hook) by which the rope can be attached to a load 22, shown resting on a ship's deck 24. Hauling in and letting out of the crane rope can be controlled by a crane driver through manual control means indicated diagrammatically at 26.

The crane is also provided with a second winch, the measuring winch, indicated generally by 28. This has a drum 30 to which a measuring line 32 is secured. The drum 30 is driven by a measuring winch motor 34 for hauling in or letting out the line 32. The measuring winch may be much smaller and of lighter construction than the crane winch. The line 32 passes over a pulley 36 at the head of the crane jib, and is provided at its extremity with attaching means 38 by which the measuring line can be attached to the load 22. Driven by the drum 30, eg by being mounted on a common shaft, is a first transducer means 40. This first transducer means is arranged to produce a displacement signal proportional to any change in relation to a predetermined value, and having regard to sign, of the length of measuring line 32 extending from drum 30 to the load 22. The displacement signal can be fed through leads 42 to the crane motor control means 16; and the control means 16 is arranged to control the crane motor 14, in accordance with said displacement signal, to haul in or let out rope 12 so that attaching means 20 moves substantially in synchronism with any movement of measuring line attachment means 38. To ensure that the first transducer means 40 produces a displacement signal as precisely as possible in accordance with any movement of attaching means 38, the motor 34 can be arranged, when required, to apply a torque to drum 30 sufficient just to keep the line 32 taut.

Both crane motor 14 and measuring winch motor 34 are powered from conventional power sources, not shown in the drawing.

In operating the invention the head of the crane jib is manoeuvred, as accurately as circumstances allow, over the centre of the load 22 to be lifted. In open sea conditions, with the crane on a different vessel from the load, there will, in general, be relative vertical movement between the load 22 and the attaching means 20 (before attachment) even when the drum 10 is rotationally stationary. The motor 34 is then energized, through measuring winch motor control means 35, to drive the drum 30 so that the measuring line 32 is paid out until the attaching means 38 can be secured to the load 22. The motor is then arranged (as already mentioned) to keep the line 32 just taut. Transducer adjusting means 44 is then actuated to bring the displacement signal for transducer 40 to a predetermined value—such as zero—for about the average vertical position of the load in relation to the crane. A switch means 46 is provided in the leads 42, and is hitherto open. The switch means is now actuated to complete the circuit to the crane motor control means 16. Any up and down motion of the load 22 in relation to the crane now actuates the first transducer means 40 to provide displacement signals (which may be +ve and −ve) and which actuate the crane motor control means 16 causing the attaching means 20 to move vertically substantially in synchronism with any movement of the load 22. Normal paying out of the crane rope 12 can be superimposed on such up and down movements by use of the manual control 26. Thus the attaching means 20 can be brought down to the load and the crane rope made secure to the load without any snatch being applied to the crane rope and hence without consequent danger to personnel. When the crane rope 20, with the load, is hauled in the switch means 46 can be operated to cut off control by the measuring line of the crane motor, since the load is no longer affected by motion of the ship's deck 24.

The preferred instant at which the load is lifted from the deck is just before the peak of any wave on which the ship is heaved up. This minimises the chance that a following peak, if higher, will bring about contact again between load and deck. Selection of the preferred instant may be made wholly by the crane driver; but it is possible to take a signal from the transducer 40 when the velocity with which the measuring line 32 is running in falls below a predetermined value (close to zero) and apply the signal to actuate the crane motor 14 to haul in continuously.

In a modified way of using the invention the extremity of the measuring line 32 is attached to the deck 24 rather than to the load 22. Movement of the load can then be synchronised with up and down movement of the ship until said load has been lifted well clear, the switch means 46 being kept closed after the crane motor 14 has been actuated to haul in the load. This modified method also provides for safe transfer of a load off the vessel on which the crane is mounted and on to another relatively heaving vessel; as in the instance of transferring a load from an oil-rig to a supply ship.

The motors and associated control means may be electric; or in an alternative arrangement may be hydraulic. In the latter instance the leads 42 would be pipes and the switch means 46 hydraulic valve means.

Desirably feed-back means 48, driven by the crane motor 14, is provided, which can supply a negative feed-back signal (ie a velocity signal) through leads 50 to the crane motor control means 16. This feed-back signal assists stable operation of the crane in conventional manner.

FIG. 2 illustrates in a highly diagrammatic and simplified way a crane indicated generally by 52, having a jib 54, crane winch drum 10, crane rope 12, and slewing means 56 including slewing motor 58, to slew the crane about vertical axis 66.

The crane is illustrated as ready to haul up a load 22 from the deck 24 of a ship 60, the crane being on an oil rig or platform 62. In such circumstances a ship, even if tied up to the rig, may be subject to more or less periodic horizontal as well as vertical movements. The horizontal movement causes the crane rope 12 to be, in general, out of vertical by an angle $\alpha$. The angular disposition of the rope 12 may cause dragging of the load 22 across the deck 24. Moreover, if the rope be out of vertical when contact is broken between load and deck the load may swing against part of the ship. Either dragging or swinging may cause injury to personnel or damage to structure. The invention provides, at the head of the crane jib 54 a second transducer 64 which coacts with the rope 12 to provide an angle signal corresponding in magnitude and sign to angular displacement from the vertical, of the crane rope 12, normal to the radial distance from the axis 66 about which the crane can slew. The angle signal can be fed from the second transducer 64 through leads 67 and switch means 68 (when closed) to slewing motor control means 70. The control means 70 is arranged to control the slewing motor 58, in accordance with any angle signal, to slew the crane in such a sense as always to tend to reduce the angle $\alpha$.

In operation, the crane is manoeuvred over the load 22 and the crane rope secured to the load as described in relation to FIG. 1. The switch means 68 is operated as soon as the crane rope 12 is taut and thereafter, through the action of the slewing motor 70, the angle is reduced substantially to zero and there maintained.

If desired, the second transducer 64 can be arranged to provide, additionally, a second angle signal related to any angle ($\beta$ say) made by the crane rope with the vertical in a direction radial with the axis 66; means being provided whereby said second angle signal controls, in the crane, luffing gear (preferably level luffing gear) in such manner as to tend always to reduce the angle $\beta$.

Lifting, slewing and luffing functions of the crane remain subject to over-riding manual control as required.

We claim:

1. A crane having a crane rope; means for attaching a load to said crane rope; a crane winch having a drum on which said crane rope can be wound; a crane motor which can drive said crane winch for hauling in or letting out said crane rope; a measuring winch having a drum with a measuring line windable thereon of length sufficient to reach at least as far as the crane rope can reach; a measuring winch motor which can turn the measuring winch drum to wind in or out said measuring line; means for attaching the outer extremity of the measuring line, away from the drum, to one of a load to be lifted by said crane and a deck supporting said load; first transducer means operated by the measuring winch to provide a displacement signal proportional to any change, in relation to a predetermined value, and having regard to sign, of the length of measuring line extending from the measuring winch drum to the said load; crane motor control means operable by said displacement signal to control the crane motor to haul in or let out the crane rope substantially in synchronism and to the same extent with any motion of the outer extremity of the measuring line; slewing means, to slew the crane about a vertical axis, including a slewing motor and slewing motor control means; and a second transducer which produces an angle signal related in magnitude and sign to angular displacement of the crane rope, from a given angle, including zero, from the vertical, normal to its radial distance from the said vertical axis; and arranged so that any said angle signal is fed to said slewing motor control means to actuate the slewing motor and slew the crane so that any said angular displacement will be substantially counteracted.

2. A crane according to claim 1 in which the second transducer is arranged also to produce a second angle signal related in magnitude and sign to angular displacement of the crane rope, from a given angle, including zero, from the vertical, in a direction radial to the said vertical axis; and arranged so that said second angle signal controls, in the crane, luffing gear so that said angular displacement, to which said second angle signal is related, will be subtantially counteracted.

3. A crane according to claim 1 having means for producing a velocity signal, related to rotation of the crane winch drum, with which negative feed-back can be applied through the crane motor control means to the crane motor.

4. A crane according to claim 1 having means for producing a velocity signal, related to slewing motion of the crane, with which negative feed-back can be applied through the slewing motor control means to the slewing motor.

5. A crane according to claim 1 having manual control means and provided with switch means whereby the transducer can be disconnected from the motor control means so that the motor is controllable through said manual control means.

* * * * *